US009298163B2

(12) United States Patent
Decosterd

(10) Patent No.: US 9,298,163 B2
(45) Date of Patent: Mar. 29, 2016

(54) TIMEPIECE WHEEL SET WITH A UNIDIRECTIONAL WHEEL

(71) Applicant: ETA SA Manufacture Horlogere Suisse, Grenchen (CH)

(72) Inventor: Cedric Decosterd, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/516,033

(22) Filed: Oct. 16, 2014

(65) Prior Publication Data

US 2015/0124569 A1 May 7, 2015

(30) Foreign Application Priority Data

Nov. 6, 2013 (EP) ..... 13191782

(51) Int. Cl.

| | |
|---|---|
| ***G04B 15/14*** | (2006.01) |
| ***G04B 1/20*** | (2006.01) |
| ***G04B 11/00*** | (2006.01) |
| ***G04B 11/02*** | (2006.01) |

(52) U.S. Cl.

CPC ..... *G04B 15/14* (2013.01); *G04B 1/20* (2013.01); *G04B 11/003* (2013.01); *G04B 11/008* (2013.01); *G04B 11/02* (2013.01)

(58) Field of Classification Search

CPC ..... G04B 13/02; G04B 11/02; G04B 11/022; G04B 3/04; G04B 5/002; G04B 15/14; G04B 1/20; G04B 11/003; G04B 11/008

USPC ..... 368/145–150, 206–208

See application file for complete search history.

(56) References Cited

U.S. PATENT DOCUMENTS

| | | | | |
|---|---|---|---|---|
| 2,749,779 | A * | 6/1956 | Godat | 74/810.1 |
| 3,838,567 | A * | 10/1974 | Giger et al. | 368/208 |
| 5,218,578 | A * | 6/1993 | Perucchi | 368/37 |
| 5,303,213 | A * | 4/1994 | Kaelin | 368/185 |
| 2004/0237688 | A1 * | 12/2004 | Kunz | 74/440 |
| 2007/0237035 | A1 * | 10/2007 | Helfer et al. | 368/147 |
| 2008/0245171 | A1 * | 10/2008 | Chaignat et al. | 74/434 |
| 2011/0149697 | A1 * | 6/2011 | Born et al. | 368/208 |
| 2011/0299366 | A1 | 12/2011 | Giacobino | |

FOREIGN PATENT DOCUMENTS

| | | | |
|---|---|---|---|
| CH | 702 924 | B1 | 10/2011 |
| EP | 1 429 213 | A2 | 6/2004 |
| EP | 1 843 225 | A1 | 10/2007 |
| EP | 2 085 832 | A1 | 8/2009 |
| EP | 1 738 229 | B1 | 6/2010 |

OTHER PUBLICATIONS

European Search Report issued May 16, 2014, in European Application No. 13191782 filed Nov. 6, 2013 (with English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P

(57) ABSTRACT

A timepiece wheel set with a unidirectional wheel including an arbor carrying a pinion and at least a first wheel that is coaxial with the pinion and pivotally mounted on the arbor. The first wheel is connected to the arbor by a first spring, which exerts a friction force on the first wheel. The wheel set also includes a second wheel pivotally mounted on the arbor, and connected to the arbor by a second spring, which exert a friction force on the second wheel.

18 Claims, 4 Drawing Sheets

TIMEPIECE WHEEL SET WITH A UNIDIRECTIONAL WHEEL

This application claims priority from European Patent Application No. 13191782.5 filed Nov. 6, 2013, the entire disclosure of which is hereby incorporated hereinby reference.

FIELD OF THE INVENTION

The invention concerns a timepiece wheel set with a unidirectional wheel including an arbor carrying a pinion and at least a first wheel coaxial with said pinion and pivotally mounted on said arbor, wherein said first wheel is connected to said arbor by first elastic rotational return means or at least a first spring forming first uncoupling means which exert a friction force on said first wheel.

The invention also concerns a timepiece movement including at least one wheel set of this type.

The invention also concerns a timepiece comprising at least one movement of this type.

The invention concerns the field of mechanical timepiece movements.

BACKGROUND OF THE INVENTION

It is often useful, in a timepiece mechanism, to be able to control the same pivoting wheel set in such a way as to obtain a different response depending on the pivoting direction applied. Such a function is generally performed by a differential mechanism, which can be bulky and costly, especially if the wheel set includes several entries.

EP Patent Application No 1429213 A2 in the name of FRANK MULLER WATCHLAND describes a unidirectional wheel with curved or inclined paddles like blades, working in buckling.

EP Patent No 1738229B1 in the name of MECO describes a hollow crown including a first elastically deformable element cooperating in a first rotational direction with a rigid element, whilst the rotational torque transmitted by one of these elements to the other is lower than a predetermined value above which the first deformable element is susceptible to be deformed and to cease its cooperation with this rigid element. A pipe is positioned in the crown housing and includes means for fixing a winding stem. The first deformable element is integral with this pipe regardless of the rotational torque value, and the rigid element is fixed with respect to the crown. The first deformable element cooperates in rotation with the internal edge of the rigid element which is annular in shape.

EP Patent No 1843225B1 in the name of ETA describes a one way reverser mechanism with an elastic coupling device capable, with at least one locking arm, of coupling or uncoupling the two wheels of a wheel set with two coaxial wheels, according to the direction of rotation of the motor pinion, at least one of these locking arms being able to cooperate with a cup on the inner periphery of the driven wheel.

CH Patent No 702 924 B1 in the name of PATEK PHILIPPE takes up the same principle, and describes a pinion and a wheel mounted coaxially, with a single elastic return means that cooperates, in certain discontinuous positions, solely between, on the one hand, a driving part integral with the pinion, and on the other hand, a female wolf-tooth toothing that includes a second drive part integral with the wheel. This elastic return means includes elastic clicks that are not continually in contact with this second drive part.

SUMMARY OF THE INVENTION

It is an object of the invention to offer a timepiece wheel set, with one or more inputs, providing a different response at output depending on the pivoting direction imposed thereon by one or another of the inputs.

To this end, the invention concerns a timepiece wheel set with a unidirectional wheel including an arbor carrying a pinion and at least one first wheel that is coaxial with said pinion and pivotally mounted on said arbor, wherein said first wheel is connected to said arbor by first elastic rotational return means or at least a first spring constituting first uncoupling means and which exert a friction force on said first wheel, characterized in that said wheel set includes a second wheel pivotally mounted on said arbor and connected to said arbor by second elastic rotational return means or at least a second spring constituting second uncoupling means which exert a friction force on said second wheel.

According to a characteristic of the invention, said first uncoupling means exert a friction force on said first wheel whose moment of torque is different according to the relative pivoting direction between said first uncoupling means and said first wheel.

According to a characteristic of the invention, said second uncoupling means exert a friction force on said second wheel whose moment of torque is different according to the relative pivoting direction between said second uncoupling means and said second wheel.

According to a characteristic of the invention, said first spring is arranged to generate a unidirectional pivoting direction with no play of said first wheel relative to said arbor of said wheel set, so as to prevent any transmission of torque to an opposing wheel set by a first toothing comprised in said first wheel during the application of torque to said pinion.

According to a characteristic of the invention, said first spring is arranged to generate a unidirectional pivoting direction with no play of said first wheel relative to said arbor of said wheel set, so as to prevent any transmission of torque to an opposing wheel set by said pinion during the application of torque to the first toothing comprised in said first wheel.

According to a characteristic of the invention, said second spring is positioned to generate a unidirectional pivoting direction with no play of said second wheel relative to said arbor of said wheel set, so as to prevent any transmission of torque to an opposing wheel set by a second toothing comprised in said second wheel during the application of torque to said pinion.

According to a characteristic of the invention, said second spring is positioned to generate a unidirectional pivoting direction with no play of said second wheel relative to said arbor of said wheel set, so as to prevent any transmission of torque to an opposing wheel set by said pinion during the application of torque to the second toothing comprised in said second wheel.

The invention also concerns a timepiece movement including at least one such wheel set characterized in that said movement includes at least one transmitting wheel set meshed with a toothing of a wheel of said wheel set, and a receiving wheel set meshed with said pinion of said wheel set.

According to a characteristic of the invention, said movement includes at least a first transmitting wheel set meshed with a first toothing of a first wheel of said wheel set and a second transmitting wheel set meshed with a second toothing of a second wheel of said wheel set.

The invention also concerns a timepiece comprising at least one movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
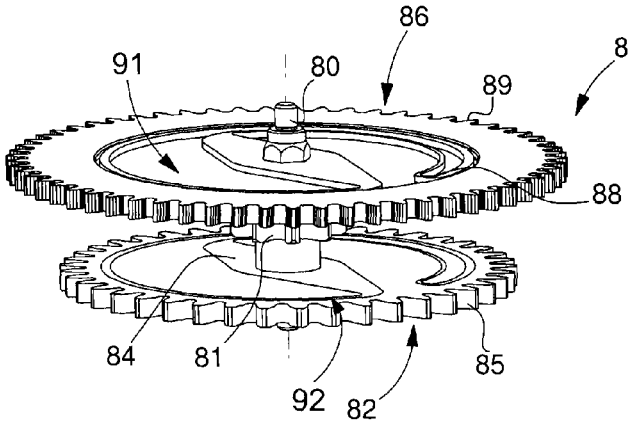
FIG. 1 shows a schematic, perspective view of a timepiece wheel set with a unidirectional wheel, including, on both sides of an arbor, a first wheel, partially free to pivot and connected by elastic return means to said arbor, and a second wheel, also partially free to pivot and connected by elastic return means to said arbor.
Figure 9:
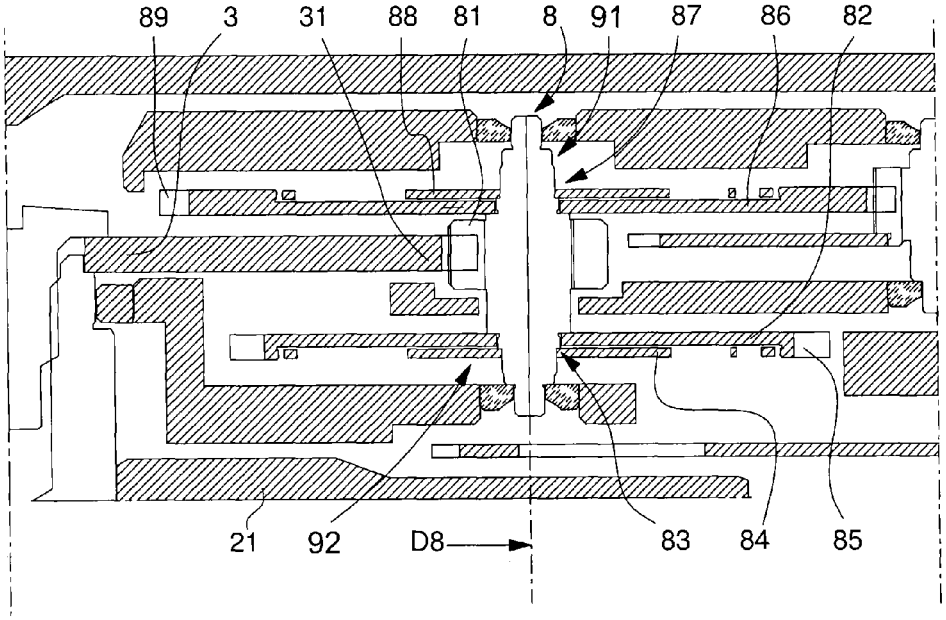
FIG. 9 shows a partial, schematic cross-section view of a timepiece movement including such a wheel set.

The invention concerns a timepiece wheel set with a unidirectional wheel 8 including an arbor 80 carrying a pinion 81 and at least a first wheel 82 that is coaxial with pinion 81 and mounted on arbor 80.

This first wheel 82 is connected to arbor 80 by first elastic rotational return means or at least a first spring 84 constituting first means of uncoupling 91, which exert a friction force on first wheel 82.

According to the invention, wheel set 8 also includes a second wheel 86 pivotally mounted on arbor 80, and which is connected to arbor 80 by second elastic rotational return means or at least a second spring 88 constituting the second means of uncoupling 92, which exert a friction force on this second wheel 86.

Advantageously, the first uncoupling means 91 exert a friction force on first wheel 82 whose moment of torque is different according to the relative pivoting direction between first uncoupling means 91 and first wheel 82.

Advantageously, the second uncoupling means 92 exert a friction force on second wheel 86 whose moment of torque is different according to the relative pivoting direction between second uncoupling means 92 and second wheel 86.

In a specific embodiment, the first spring 84 is arranged to generate a unidirectional pivoting direction with no play of first wheel 82 relative to arbor 80 of wheel set 8, so as to prevent any transmission of torque to an opposing wheel set by a first toothing 85 comprised in first wheel 82 during the application of torque to pinion 81.

In a specific embodiment, the first spring 84 is arranged to generate a unidirectional pivoting direction with no play of first wheel 82 relative to arbor 80 of wheel set 8, so as to prevent any transmission of torque to an opposing wheel set by pinion 81 during the application of torque to first toothing 85 comprised in first wheel 82.

In a specific embodiment, the second spring 88 is arranged to generate a unidirectional pivoting direction with no play of second wheel 86 relative to arbor 80 of wheel set 8, so as to prevent any transmission of torque to an opposing wheel set by a second toothing 89 comprised in second wheel 86 during the application of torque to pinion 81.

In a specific embodiment, the second spring 88 is arranged to generate a unidirectional pivoting direction with no play of second wheel 86 relative to arbor 80 of wheel set 8, soy as to prevent any transmission of torque to an opposing wheel set by pinion 81 during the application of torque to second toothing 89 comprised in second wheel 86.

In a specific embodiment, first wheel 82 and second wheel 86 are unidirectional in the same pivoting direction.

In a specific embodiment, first wheel 82 comprises a first toothing 85 that is different from a second toothing 89 comprised in said second wheel 86.

In a specific embodiment, first spring 84 is identical to second spring 88.

The invention also concerns a timepiece movement 100 including at least one such wheel set 8. According to the invention, this movement 100 includes at least one transmitting wheel set 1, 2, meshed with a toothing 85, 89, of a wheel 82, 86 of wheel set 8, and a receiving wheel set 3 meshed with pinion 81 of wheel set 8.

In a specific embodiment, movement 100 includes at least a first transmitting wheel set 1 meshed with a first toothing 85 of a first wheel 82 of said wheel set 8 and a second transmitting wheel set 2 meshed with a second toothing 89 of a second wheel 86 of wheel set 8.

The invention also concerns a timepiece 200, particularly a watch, including at least one such timepiece movement 100.

Thus, first means of uncoupling 91, constituted by the first elastic rotational return means or by the at least one first spring 84, exert a friction force on first wheel 82, whose moment of torque is different according to the relative pivoting direction between first means of uncoupling 91 and first wheel 82.

FIG. 1 shows a specific, non-limiting embodiment of a mounted wheel set 8, composed of five parts: a preferably 20AP steel turned arbor 80, first wheel 82 and second wheel 86, which pivot freely, and first spring 84 and second spring 88 which ensure that these wheels are driven or not driven.

The function of the first unidirectional wheel 82 and the second unidirectional wheel 86, preferably manufactured in hardened copper-beryllium (CuBe), is to drive arbor 80 when under torque from an external origin.

However, they must not transmit torque when they are driven by arbor 80 (uncoupling system between the two wheels). In addition, the wheel 82 or 86 must not have a dead angle, as opposed to a ratchet wheel for example. The toothing 85 and 89 of these wheels 82 and 86 are also optimised to minimise play in the gears. The very different behaviour of each spring 84, 88, according to the direction of torque applied thereto can be simplified in a first "free" direction and in a second "friction" direction of driving. However, even in the "free" direction of the spring, there is slight friction between the spring and the wheel concerned, due to slight prestressing applied to the spring on its external diameter, which means that the wheel will be driven by this low friction torque, and will turn until it takes up the play with the next wheel or pinion.

The two wheels 82 and 86 are preferably designed to receive the same spring, thus limiting the number of components. Their pivoting diameters are also preferably identical. This also makes it possible to have the same dimension for attaching the spring to the centre on the six-sided drive shaft of arbor 80.

The first 84 or second 88 flexible spring has the function of driving the arbor 80 when it acts in a locking direction. In the event that the arbor 80 drives a spring, it should not drive the corresponding wheel. Preferably, the friction torque is minimised and the locking torque is maximised.

It is understood that this type of uncoupling system is essential to avoid undesired force feedback by a gear train.

Wheel set 8 forms a unidirectional wheel whose operation resembles a reverser click wheel. Wheel set 8 represents great progress compared with known reversers, as it is far less voluminous, and therefore easier to fit into a movement 100. Wheel set 8 according to the invention has no dead angle, which means that it may be mounted in an automatic movement.

Figure 2:
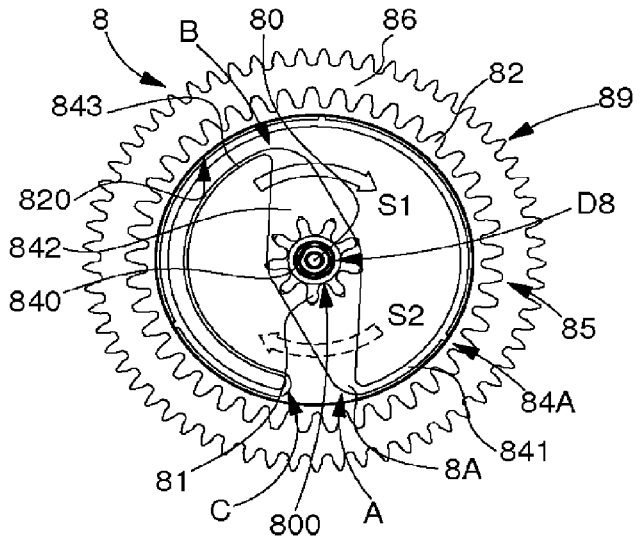
FIGS. 2 to 8 show schematic, plan views of different variants of the elastic return means equipping the first wheel and/or the second wheel.

FIGS. 2 to 8 illustrate various non-limiting geometries of springs, which equally applicable r to first spring 84 or second spring 88. FIG. 2 shows more specifically first spring 84 housed in first additional ratchet drive wheel 82, and FIGS. 3 to 8 show second spring 88 housed in the second additional ratchet drive wheel 86. They are fixed to the corresponding wheel by means of friction: an external coil 841, 881 respectively, of first spring 84, respectively of second spring 88, cooperates with a housing 820, 860 respectively, on wheel 82, 86 respectively, in which it is held by friction on its edge and/or by tabs 84A, 88A respectively, comprised in first spring 84, respectively second spring 88. The inner part of each spring, 842, 882 respectively, cooperates with arbor 80, via a female part 840, 880 respectively, of first spring 84, respectively of second spring 88, with a complementary profile to a male part 800 of arbor 80.

The specific profile of the springs illustrated, with asymmetric stiffness of at least one arm 843, 883 respectively, connecting the inner part of each spring, 842, 882 respectively, to its external part 841, 881 respectively, makes it possible to apply torque with a large difference in moment, depending on whether the relative pivoting movement between arbor 80 and the respective wheel is in one direction or the other. The torque ratio applied in one direction relative to the other is preferably higher than 3 according to the shape of the spring, the sections used, and the pairs of materials used, this ratio can be considerably increased, particularly over a factor of 10. Ideally, the torque ratio applied in one direction relative to the other should be infinitely large.

Figure 3:
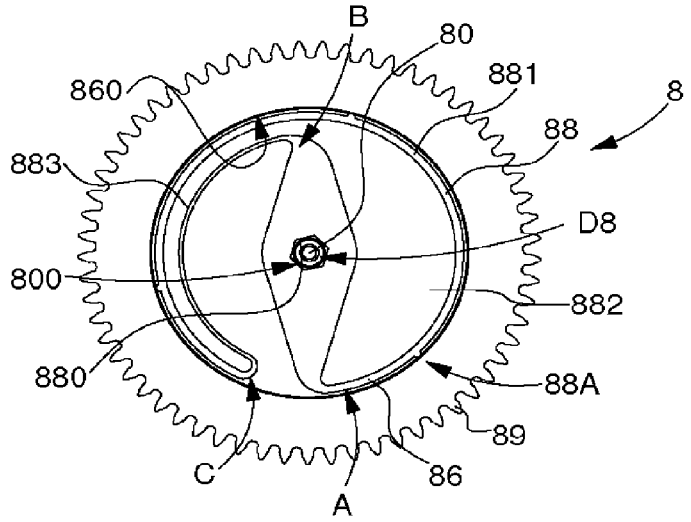

In FIGS. 2 and 3, the spring profile is closed: the inner part of each spring, 842, 882 respectively, is diamond shaped centred on arbor 80, one of the ends A of the diamond constituting the start of the external part 841, 881 respectively, which is circular for almost a complete turn, before winding around itself at point C and forming an arm 843, 883 respectively, with a circular section for about half a turn, with a smaller radius than the external part, attached to point B at the other end of the diamond symmetrically to the first end A.

Figure 4:
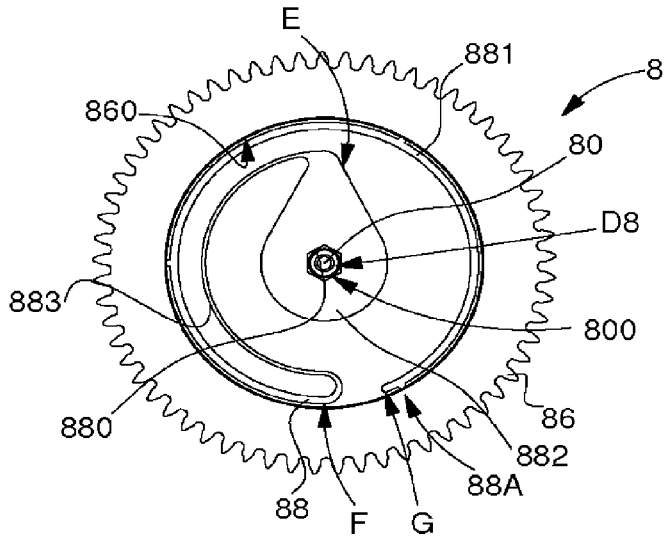

In FIG. 4, the spring profile is open: the inner part, 842, 882 respectively, has the shape of a disk extended over radius by a triangle, whose distal point E constitutes the start of an arm 843, 883 respectively, in a circular sector of approximately half a turn, before winding around itself at point F and forming the external part 841, 881 respectively, which is circular for almost a complete turn, with a radius larger than the arm, before stopping at a distal end G.

Figure 5:
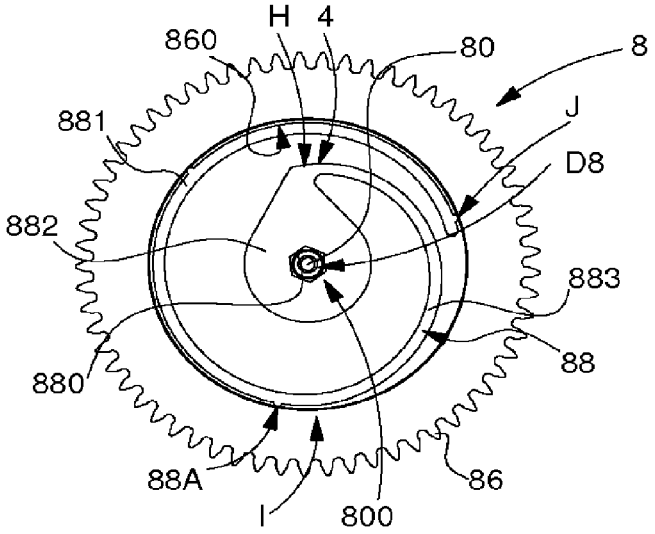

In FIG. 5, the spring profile is open: the inner part, 842, 882 respectively, has the shape of a disk extended over a radius by a triangle, whose distal point H constitutes the start of an arm 843, 883 respectively, with a spiral increasing over approximately half a turn to a point I where the circular external part 841, 881 respectively, starts, before stopping at a distal end J, after approximately one and a quarter turns in relation to point H.

Figure 6:
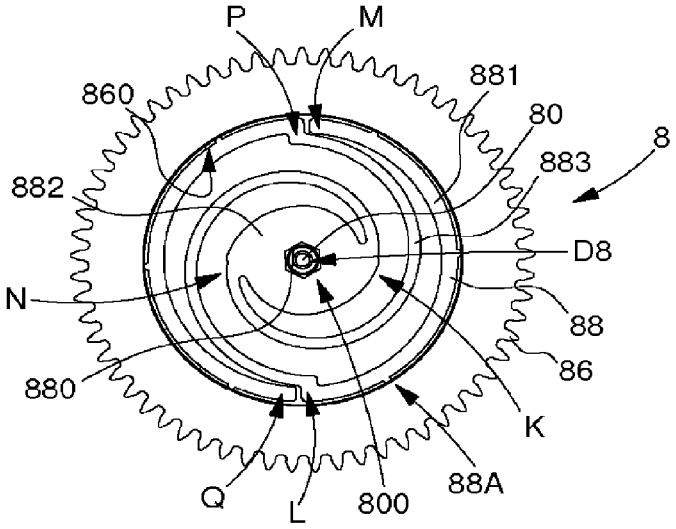

In FIG. 6, the spring profile is open, the spring includes two symmetrical strands: the inner part, 842, 882 respectively, is in the shape of a disk to which is attached at K, N, an arm 843, 883 respectively, in a spiral increasing over approximately three quarters of a turn to point L, P, where the circular external part 841, 881 respectively, starts for half a turn, before stopping at a distal end M, Q.

Figure 7:
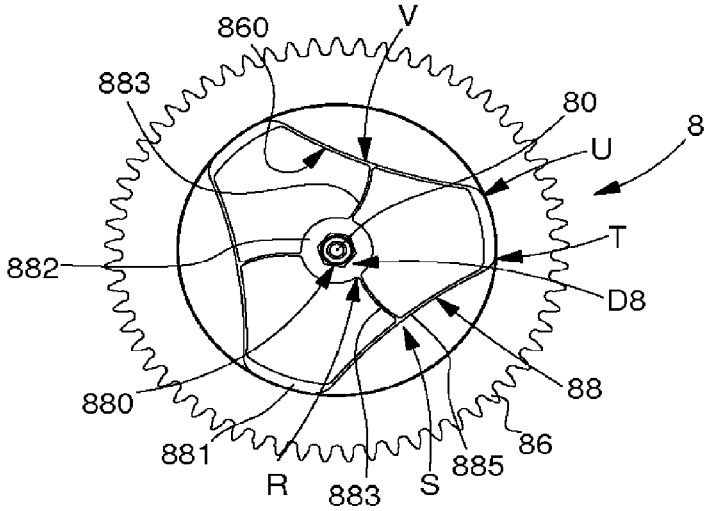

In FIG. 7, the spring profile is closed, and includes a mesh with a pitch of 120°: the inner part, 842, 882 respectively, is in the shape of a disk, from which there starts, at point R, a substantially radial but curved arm 843, 883 respectively, which joins, at point S, a chord 885 that joins two circular sectors of larger diameter, including a sector TU forming an external part 841, 881 respectively, the spring starting again from point U on another chord 885 at about 120° from the former, and joining at point V another radial curved arc similar to the first, point V being the conjugate of starting point S.

Figure 8:
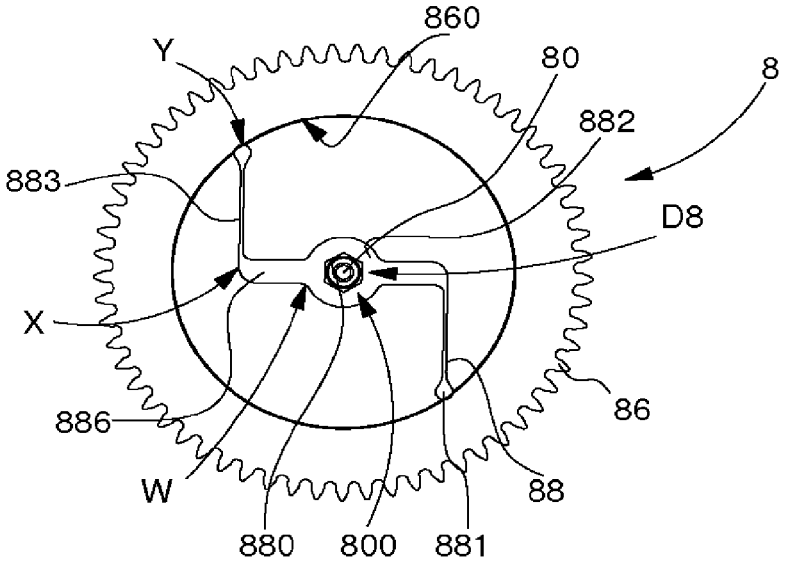
Figure 10:
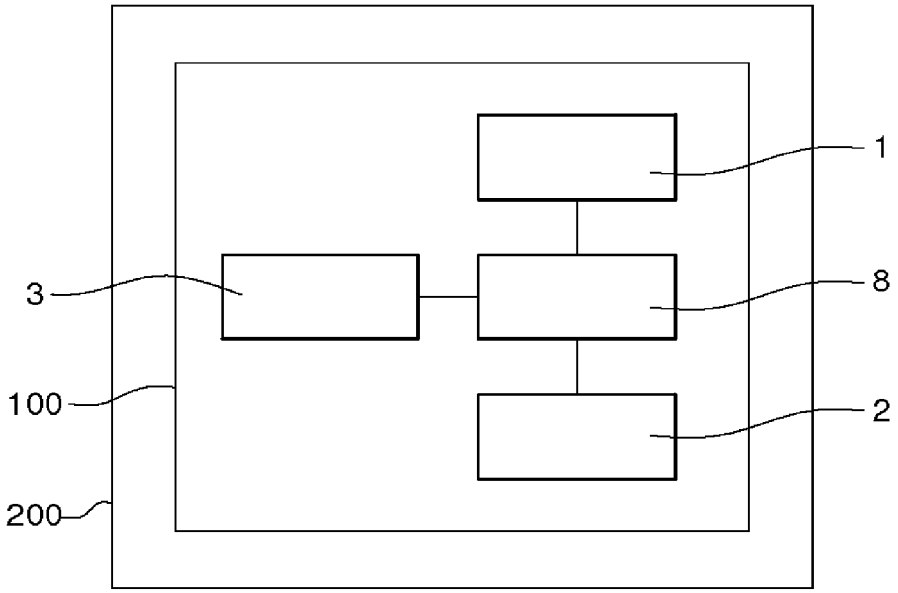
FIG. 10 shows, in the form of a block diagram, a timepiece including a movement of this type.

In FIG. 8, the spring profile is open, the spring comprising two symmetrical strands: the inner part, 842, 882 respectively, is in the shape of a disk to which is attached at W a radial arm 886 having a large section, to a point X from which projects at right angles an arm 843, 883 respectively, having a smaller section than radial arm 886, to a distal end Y at the periphery of the wheel.

The springs of FIGS. 2 to 8 can be created by stamping, or, for those with very fine strands, using a "LIGA", "DRIE" or similar manufacturing process.

The mechanism according to the invention meets the following criteria well:

safety of the system during operation, simplicity of production and implementation in an existing movement, reliability of the system for both manual and automatic movements, optimal energy reinjection efficiency and maximal reduction of losses, limitation of the number of components and their complexity.

The functions of taking up play and locking are performed on each occasion directly by a single component.

What is claimed is:

1. A timepiece wheel set, comprising:

a unidirectional wheel including an arbor carrying a pinion;

at least one first wheel that is coaxial with said pinion and pivotally mounted on said arbor, wherein said first wheel is connected to said arbor by a first spring, the first spring including an external coil in contact with a radially inward facing surface of the first wheel to apply a friction force to said first wheel, and the first spring including an internal part in contact with the arbor such that the first spring drives the arbor when the first spring is rotated by the first wheel in a locking direction of the first spring; and a second wheel pivotally mounted on said arbor and connected to said arbor by a second spring the second spring including an external coil in contact with a radially inward facing surface of the second wheel to apply a friction force to said second wheel, and the second spring including an internal part in contact with the arbor such that the second spring drives the arbor when the second spring is rotated by the second wheel in a locking direction of the second spring.

2. The wheel set according to claim 1, wherein said friction force exerted on said first wheel by the first spring includes a moment of torque that is different according to the relative pivoting direction between said first spring and said first wheel.

3. The wheel set according to claim 1, wherein said friction force exerted on said second wheel by the second spring includes a moment of torque is different according to the relative pivoting direction between said second spring and said second wheel.

4. The wheel set according to claim 1, wherein said first spring is arranged to generate a unidirectional pivoting direction with no play of said first wheel relative to said arbor of said wheel set, so as to prevent any transmission of torque to an opposing wheel set by a first toothing comprised in said first wheel during the application of torque to said pinion.

5. The wheel set according to claim 1, wherein said first spring is arranged to generate a unidirectional pivoting direction with no play of said first wheel relative to said arbor of said wheel set, so as to prevent any transmission of torque to an opposing wheel set by said pinion during the application of torque to a first toothing comprised in said first wheel.

6. The wheel set according to claim 1, wherein said second spring is arranged to generate a unidirectional pivoting direction with no play of said second wheel relative to said arbor of said wheel set, so as to prevent any transmission of torque to an opposing wheel set by a second toothing comprised in said second wheel during the application of torque to said pinion.

7. The wheel set according to claim 1, wherein said second spring is arranged to generate a unidirectional pivoting direction with no play of said second wheel relative to said arbor of said wheel set, so as to prevent any transmission of torque to an opposing wheel set by said pinion during the application of torque to a second toothing comprised in said second wheel.

8. The wheel set according to claim 1, wherein said first wheel and said second wheel are unidirectional in the same pivoting direction.

9. The wheel set according to claim 1, wherein said first wheel comprises a first toothing, that is different from a second toothing comprised in said second wheel.

10. The wheel set according to claim 1, wherein said first spring is identical to said second spring.

11. A timepiece movement comprising:

at least one wheel set according to claim 1, wherein said movement includes at least one transmitting wheel set meshed with a toothing of a wheel of said wheel set, and a receiving wheel set meshed with said pinion on said wheel set.

12. The timepiece movement according to claim 11, wherein said movement includes at least a first transmitting wheel set meshed with a first toothing of a first wheel of said wheel set and a second transmitting wheel set meshed with a second toothing of a second wheel of said wheel set.

13. A timepiece comprising:

at least one movement according to claim 12.

14. A timepiece comprising:

at least one movement according to claim 11.

15. The wheel set according to claim 1, wherein the inner part of said first spring is diamond shaped and the external coil extends from one end of the diamond shape.

16. The wheel set according to claim 1, wherein the first wheel and the second wheel are positioned directly between the first spring and the second spring in a direction parallel to a rotational axis of the arbor.

17. The wheel set according to claim 1, wherein the external coil of the first spring includes tabs in contact with the radially inward facing surface of the first wheel.

18. The wheel set according to claim 1, wherein the external coil of the second spring includes tabs in contact with the radially inward facing surface of the second wheel.

* * * * *